US008910856B2

(12) United States Patent
Sumpmann et al.

(10) Patent No.: US 8,910,856 B2
(45) Date of Patent: Dec. 16, 2014

(54) SHIPPING AND DISPLAY CONTAINER

(75) Inventors: Patrick J. Sumpmann, Maple Grove, MN (US); Dale Pusch, Conyers, GA (US)

(73) Assignee: General Mills, Inc., Minneapolis, MN (US)

( * ) Notice: Subject to any disclaimer, the term of this patent is extended or adjusted under 35 U.S.C. 154(b) by 264 days.

(21) Appl. No.: 13/475,265

(22) Filed: May 18, 2012

(65) Prior Publication Data

US 2013/0306718 A1 Nov. 21, 2013

(51) Int. Cl.
*B65D 17/28* (2006.01)

(52) U.S. Cl.
USPC ..... 229/235; 229/237; 206/746

(58) Field of Classification Search
USPC ..... 229/200, 235, 237, 240–242; 206/746, 206/736
See application file for complete search history.

(56) References Cited

U.S. PATENT DOCUMENTS

| | | | | |
|---|---|---|---|---|
| 4,113,100 | A | 9/1978 | Soja et al. | |
| 4,553,666 | A | 11/1985 | Gullikson | |
| 5,167,324 | A * | 12/1992 | Miller | 206/738 |
| 5,366,142 | A | 11/1994 | Hough | |
| 6,073,833 | A * | 6/2000 | Desrosiers et al. | 229/235 |
| 6,435,351 | B1 * | 8/2002 | Gibb | 206/736 |
| 6,554,135 | B1 | 4/2003 | Luceri et al. | |
| 7,175,066 | B2 * | 2/2007 | Varanasi | 229/235 |
| 7,628,746 | B2 | 12/2009 | Varanasi | |
| 2006/0016864 | A1 * | 1/2006 | Harrelson | 229/122.1 |
| 2007/0108090 | A1 | 5/2007 | Whiteside et al. | |
| 2011/0049226 | A1 | 3/2011 | Moreau et al. | |

FOREIGN PATENT DOCUMENTS

| | | |
|---|---|---|
| GB | 1520806 | 8/1978 |

* cited by examiner

*Primary Examiner* — Justin Larson
*Assistant Examiner* — Phillip Schmidt
(74) *Attorney, Agent, or Firm* — Everett G. Diederiks, Jr.; Gregory P. Kaihoi

(57) ABSTRACT

A packaging container, adapted to be cut to establish a display container for products stored therein, is formed with corner slits having a primary slit portion extending around a respective corner of the container, as well as secondary slit portions which extend at non-linear angles to the primary slit portion. Between the corner slits, the container can be provided with cut lines to act as a guide for a cutting instrument used to separate the container into top and bottom sections, with the bottom section establishing the display container. With the inclusion of the corner slits, the cutting instrument need not make any cuts through the corners. In addition, cuts made between the corner slits need not be perfectly aligned between respective primary slit portions due to the existence of the secondary slit portions.

30 Claims, 5 Drawing Sheets

SHIPPING AND DISPLAY CONTAINER

FIELD OF THE INVENTION

The invention generally pertains to packaging, shipping and displaying products in containers and, more particularly, to a container and method of making the same, wherein the container is configured to store various items for transport but can be conveniently and easily cut open to expose the items and even transform the container into a display for the items.

BACKGROUND OF THE INVENTION

In connection with shipping products from a manufacturer to a retail establishment, it is known to package various products in a container, seal the container, and ship the container for delivery to a designated retail establishment. Although various materials could be used in making the containers, the most common material employed is corrugated cardboard or paperboard. In general, the paperboard is provided in the form of a blank which can be conveniently stored in a flat configuration but easily erected through a simple folding operation to establish an open-ended container which can be filled and sealed, typically in an automated process. These containers are not only lightweight and quite strong, but the paperboard is advantageously recyclable.

In some situations, the containers are shipped directly from the manufacturer to various retail establishments while, in other cases, the manufactured products are first shipped in the containers to a designated distributorship which then redirects the containers to the appropriate store. In either situation, it was not uncommon to display the products at the store in containers of this type. That is, many stores wish to minimize the time and cost associated with removing the individual products from the containers and placing the products directly on display shelves. Instead, the container is simply placed in an accessible location for consumers with the products being exposed to enable the consumers to select a desired product directly from the container. To expose the products, the paperboard containers are generally cut to remove a substantial portion of the container body, thereby exposing the product and enhancing the overall visual effect for the purchaser.

In the past, it was not uncommon for a store employee to be provided with a box cutter for the purpose of converting a shipping container to a display container. However, when cutting open the container, care must be taken to avoid also cutting into the packaged product. In any case, for various reasons, the industry has moved away from providing this type of instrument to employees. As simply tearing the boxes open leads to an unsightly result, it has been proposed to incorporate score lines directly into the containers. Typically, the score lines are created by forming side walls of a container with a series of aligned perforations such that, when portions of the sides are manually pulled apart, the container will tend to tear along the perforations, thereby establishing a more aesthetic result. Unfortunately, this type of arrangement still has a propensity for unintended tears and the score lines tend to undesirably weaken the overall structural integrity of the container. The structural integrity can prove quite important, particular depending on the type of packaged products and the manner in which the containers are moved. For instance, if the products are liquids packaged in glass containers, the overall container can be rather heavy and, if the containers are loaded/unloaded utilizing clamp or similar-type work trucks, the containers can easily fail.

In light of these and other drawbacks, it is actually now quite common for packaged products to be shipped to a distributor, which is relatively close to the final product destination, in a shipping container. At the distributor, the shipping container is opened, either manually or through an automated process, and the contents of the container are transferred to another container which can also double as a display designed for placement either on the floor or a shelf of a store. For example, this type of delivery process is widely used in the food industry. For instance, it is known to pack and seal various cartons or boxes of cereal in a paperboard container, ship the container to a distributor, cut the container along four sides to expose the cartons of cereal in an automated operation, manually separate the container portions, transfer the cartons of cereal to a display container and then deliver the cartons of cereal in the display container to a designated grocery store. Even though both the shipping and display containers can be recycled and the result is quite convenient for the store owners, the overall process is quite labor intensive and costly. In addition to these drawbacks, it has been found that the automated cutting operation cannot be reliably practiced with certain products. More specifically, cartons of cereal, particularly those located at the corners of the shipping containers, are sometimes sliced during the cutting operation, resulting in product which can no longer be sold. Certainly, material and labor savings can be realized by reducing the need for separate shipping and display containers. However, to benefit from this savings, a reliable system must be in place to assure that shipping containers can be reliably converted to aesthetically pleasing display containers or cases, particularly without damaging the packaged products.

SUMMARY OF THE INVENTION

The invention is directed to pre-forming a container, adapted to be cut in order to expose products stored therein, with corner slits having a primary slit portion extending around a respective corner of the container, as well as secondary slit portions which extend at a non-linear angle to the primary slit portion. Between the corner slits, the container can be provided with cut lines to act as a guide for a cutting instrument used to separate the container into top and bottom sections, with the bottom section establishing a display container or case. With the inclusion of the corner slits, the cutting instrument need not make any cuts through the corners. In addition, cuts made between the corner slits need not be perfectly aligned between respective primary slit portions due to the existence of the secondary slit portions. Instead, the relatively angled secondary slit portions advantageously provide for a range of permissible cuts.

The invention can be employed in packaging and displaying a wide range of products. In addition, by simply repositioning the relative locations of the various corner slits, display containers of various configurations can be readily established. In any case, additional objects, features and advantages of the invention will become more readily apparent from the following detailed description when taken in conjunction with the drawings wherein like reference numerals refer to corresponding parts in the several views.

DETAILED DESCRIPTION OF EMBODIMENTS

Figure 1:
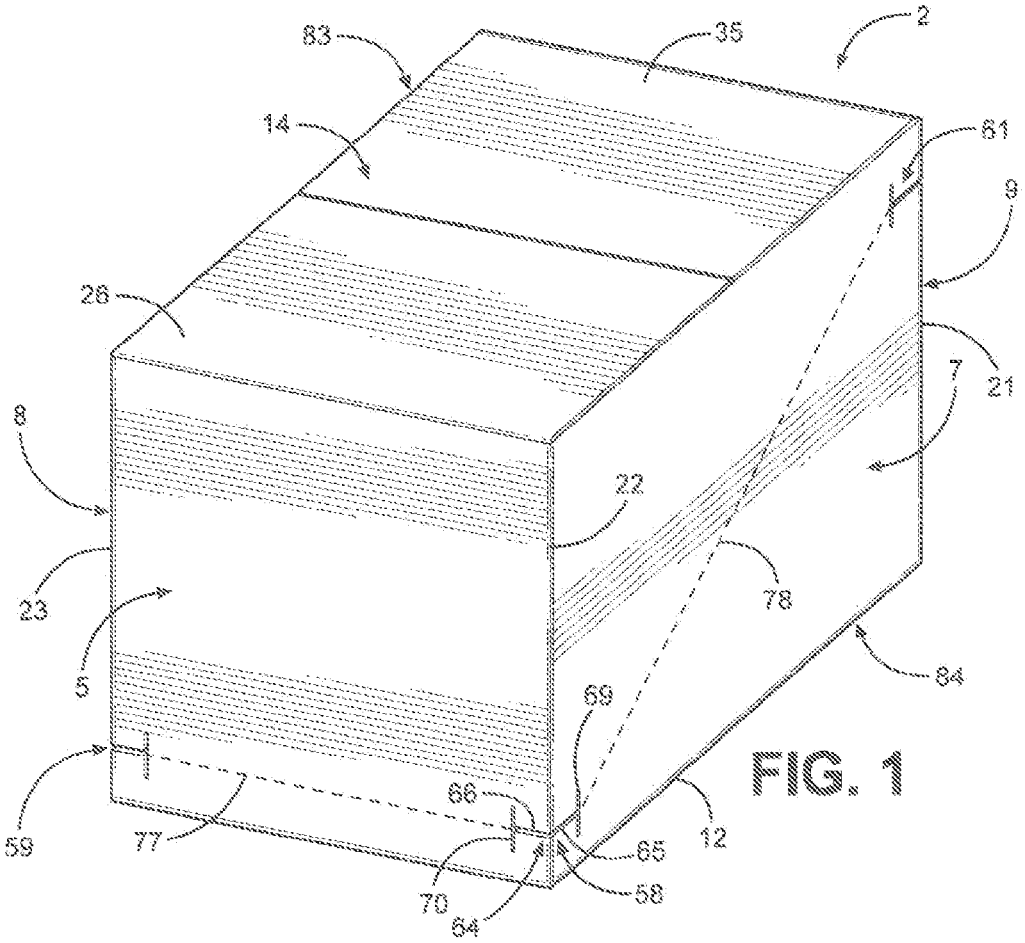
FIG. 1 is a perspective view of a combination shipping and display container constructed in accordance with a first embodiment of the invention.
Figure 3:
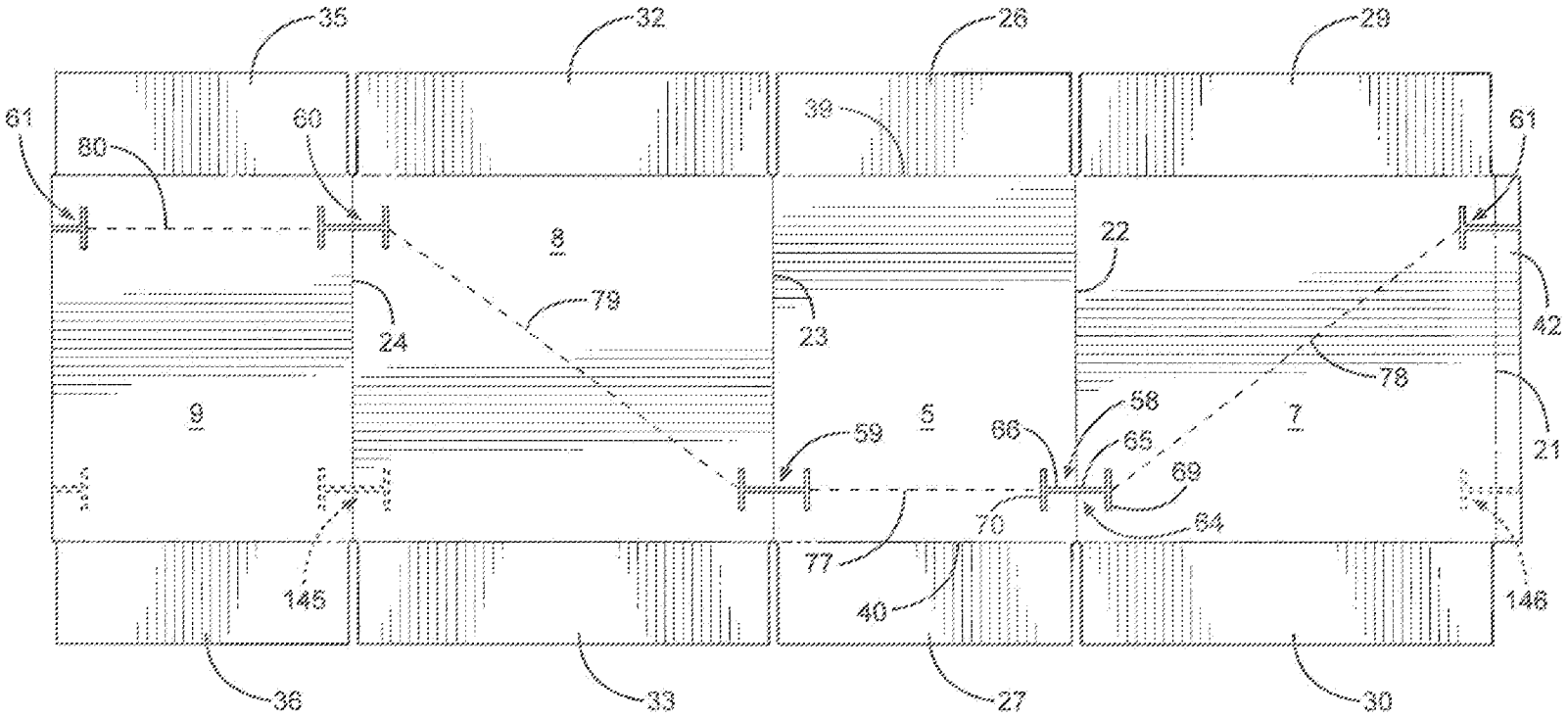
FIG. 3 is a top plan view of a blank used in establishing the container of FIG. 1.

With initial reference to FIG. 1, a container constructed in accordance with the invention is generally indicated at 2. As shown, container 2 includes a front panel 5, side panels 7 and 8, a rear or back panel 9, a bottom panel 12 and a top panel 14. Although container 2 can be formed in various fashions and from a wide range of materials, as shown, container 2 is formed of corrugated cardboard or paperboard, mainly due to its strong, lightweight and recyclable characteristics. Although paperboard containers or boxes can be formed and erected in various ways, it is typical for a corrugated paperboard container to be initially in the form of a blank defining a flat sheet of paperboard that has been cut to particular dimensions and a predetermined design, as well as scored to establish fold lines. An exemplarily blank for use in establishing container 2 is illustrated in FIG. 3. As shown in each of FIGS. 1 and 3, various fold lines are established, such as fold lines 21-24 between side panel 7 and back panel 9, front panel 5 and side panel 7, front panel 5 and side panel 8, and side panel 8 and back panel 9 respectively. In the embodiment shown, bottom panel 12 and top panel 14 are formed by providing each of front panel 5, side panels 7 and 8, and back panel 9 with upper and lower flaps. More specifically, as illustrated, front panel 5 is provided with an upper flap 26 and a lower flap 27; side panel 7 is provided with an upper flap 29 and a lower flap 30; side panel 8 is provided with an upper flap 32 and a lower flap 33; and back panel 9 is provided with an upper flap 35 and a lower flap 36. As it would be readily understood by one of ordinary skill in the art, these flaps have associated fold lines as well. By way of example, upper flap 26 associated with front panel 5 has a fold line 39, while lower flap 27 has an associated fold line 40. In any case, at this point it should be readily understood that the blank shown in FIG. 3 can be folded along lines 21-24, while lower flaps 27, 30, 33 and 36 are folded to establish bottom panel 12 and upper flaps 26, 29, 32 and 35 are folded to establish top panel 14. For use in connection with attaching side panel 7 to back panel 9, an elongated tab 42 extends from side panel 7 and is adapted to be adhesively (hot or cold), taped, stapled or otherwise secured to either the inside or outside of back panel 9.

Again, the structure described above in forming container 2 is known and would be readily understood by one of ordinary skill in the art. In addition, at this point, it should be realized that container 2 can be formed in various other ways, such as providing a blank having a solid bottom panel with various panels and flaps which fold and secure to each other to establish other panel portions of the container. Furthermore, the flaps, when folded, can meet or touch each other, or a gap can be established between them. In general, it should just be understood that the invention can be employed with any known configuration of shipping container of this type. In any case, at this point, it is merely important to recognize that, once erected, container 2 can be used to store and transport various articles as will be discussed more fully below.

Figure 2:
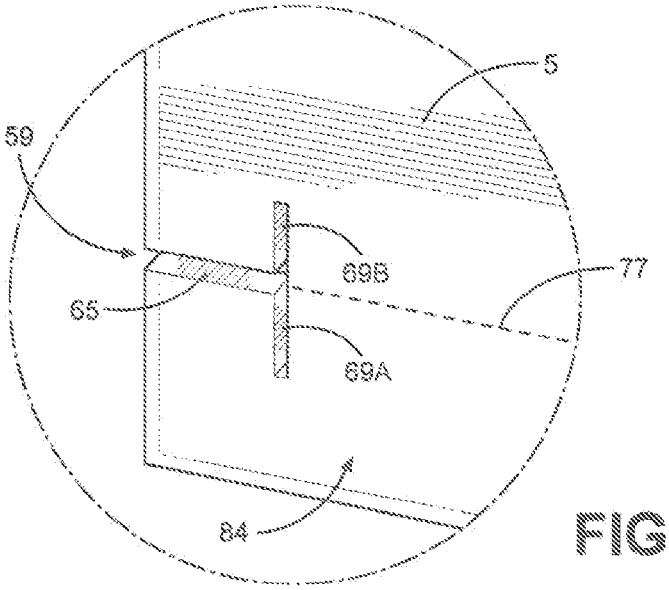
FIG. 2 is an enlarged view of a corner portion of the container of FIG. 1.

Regardless of the exact construction for container 2, there will be established a series of corners which, in the embodiment depicted, are established by fold lines 21-24. In accordance with the invention, each of these corners is configured to extend vertically, while being provided with a pre-formed corner slit 58-61. As illustrated in each of FIGS. 1-3, each corner slit 58-61 is similarly constructed to include a primary or first slit portion 64 which extends in a predetermined direction and around a respective corner of container 2. More specifically, each primary slit portion 64 includes a first segment 65 which leads to a respective corner and which opens into a second segment 66. By way of example, FIG. 1 illustrates first segment 65 leading to the vertical corner defined by fold line 22 and extending through the corner so as to be adjoined with second segment 66 that extends into front panel 5. In addition to primary slit portion 64, each corner slit 58-61 includes secondary slit portions 69 and 70. As clearly illustrated in these figures, secondary slit portions 69 and 70 extend at a non-linear angle relative to primary slit portion 64. In the particular embodiment shown, secondary slit portions 69 and 70 extends substantially perpendicular to primary slit portion 64 and are established at terminal ends of first segment 65 and second segment 66 respectively. As best shown in FIG. 2 and exemplified with reference to second slit portion 69, part of second slit portion 69 extends below first segment 65 (see second slit portion 69A) and another part of second slit portion 69 extends above first segment 65 (see second slit portion 69B).

As indicated above, it is quite common to utilize containers for use in shipping packaged products to a desired destination. In addition, it is desirable to open the containers in order to provide access to those products. Finally, in certain situations, it can be desirable to open the container in a manner which will enable at least a portion of the container to be retained and used for display purposes. In accordance with the invention, corner slits 58-61 are specifically arranged about container 2 and configured to enhance the accurate and clean cutting of container 2. To this end, it should be noted that the embodiment of these figures provides corner slits 58 and 59 at positions spaced slightly above, such as in the order of a couple inches, bottom panel 12, while corner slits 60 and 61 are provided slightly below top panel 14. Certainly, the exact distance from bottom panel 12 and top panel 14 for corner slits 58-61 can be varied without departing from the invention. In any case, it is between the various corner slits 58-61 that container 2 is designed to be cut. To illustrate this point, container 2 is shown to include various cut lines 77-80 as best shown in FIGS. 1 and 3. More specifically, cut line 77 extends between corner slits 58 and 59, cut line 78 extends between corner slits 58 and 61, cut line 79 extends between corner slits 59 and 60, and cut line 80 extends between corner slits 60 and 61. Given the relative heights of corner slits 58 and 59, cut line 77 is generally horizontal, while a similar horizontal arrangement is provided for cut line 80. On the other hand, cut lines 78 and 79 extend diagonally across side panels 7 and 8 respectively.

At this point, it should be recognized that cut lines 77-80 are provided to assist or guide the user in converting container 2 to a display container, while also aiding the reader in fully understanding the invention. Cut lines 77-80 can be established on container 2 by providing markings, such as dotted lines or the like. However, cut lines 77-80 are not required in accordance with the invention, but can be provided to illustrate a guideline for cutting container 2 between respective second and third slit portions 69 and 70 along each of front panel 5, side panels 7 and 8, and back panel 9. Once cuts are made along lines 77-80, due to the inclusion of pre-formed corner slits 58-61, container 2 will be divided into an upper panel portion 83 and a lower panel portion 84 which are generally indicated in FIG. 1.

Figure 4:
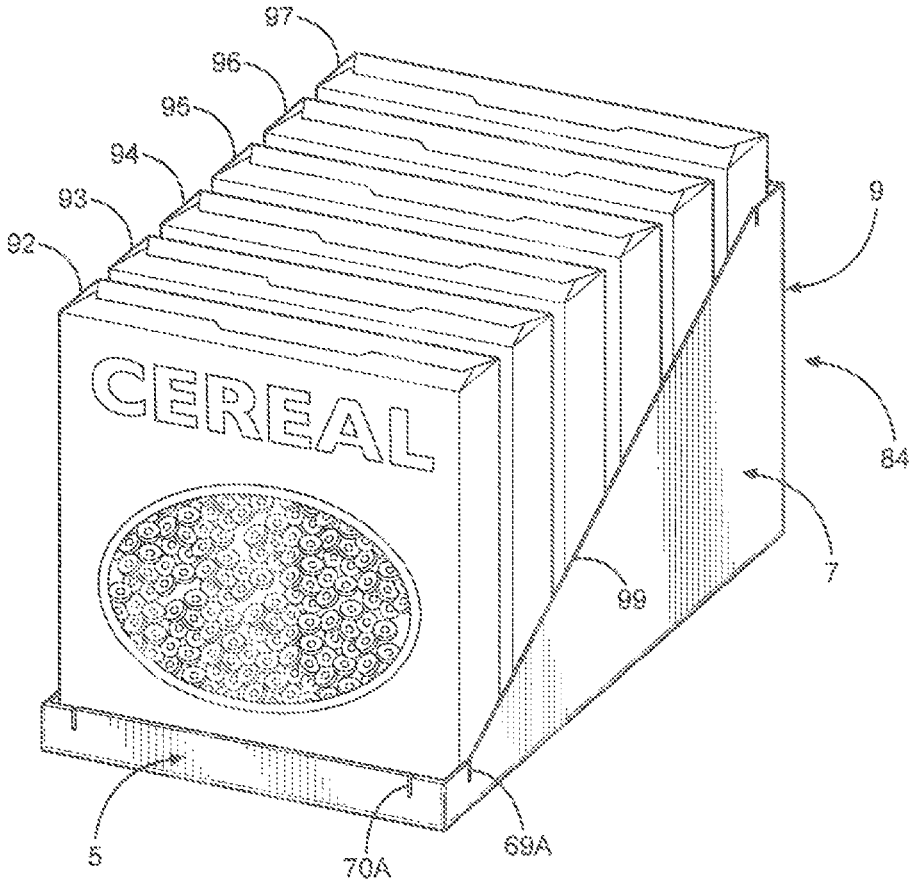
FIG. 4 is a perspective view of the container of FIG. 1 shown cut to establish a display container.

Reference will now be mainly made to FIG. 4 illustrating container 2 having been cut to establish lower container portion 84 and to expose a plurality of products which, in the depicted embodiment, are established by cartons or boxes of cereal 92-97. As should be evident from viewing this figure, severing side panels 7 and 8 along angled cut lines 78 and 79 establish respective sloping upper side edges 99, thereby retaining portions of side panels 7 and 8 to provide retention for products 92-97. By way of example, establishing sloping upper side edge 99 along side panel 7 need not be made by a cut which specifically extends from first segment 65 of primary slit portion 64 at corner slit 58 to secondary segment 66 of primary slit portion 64 at corner slit 61. Instead, the inclusion of secondary slit portions 69 and 70 for each of the corner slits 58-61 advantageously enables a significant variation in the actual angle for sloping upper side edge 99 as the cut need only intersect any part of secondary slit portions 69 and 70. The same is true with respect to the cuts made along each of the panels 5, 7, 8 and 9. Therefore, depending upon how the cuts are made, certain parts of second slit portion 69 and third slit portion 70 can remain as part of lower container portion 84, such as indicated at 69A and 70A in FIG. 4. Again, each second slit portion 69 includes a lower second slit segment 69A and an upper second slit segment 69B as represented in FIG. 2. Therefore, the actual cut can intersect secondary slit portion 69 anywhere within secondary slit segments 69A and 69B. Still, given the existence of corner slits 58-61 formed into container 2, no cuts need to be made around the corners defined by vertical fold lines 21-24.

Figure 5:
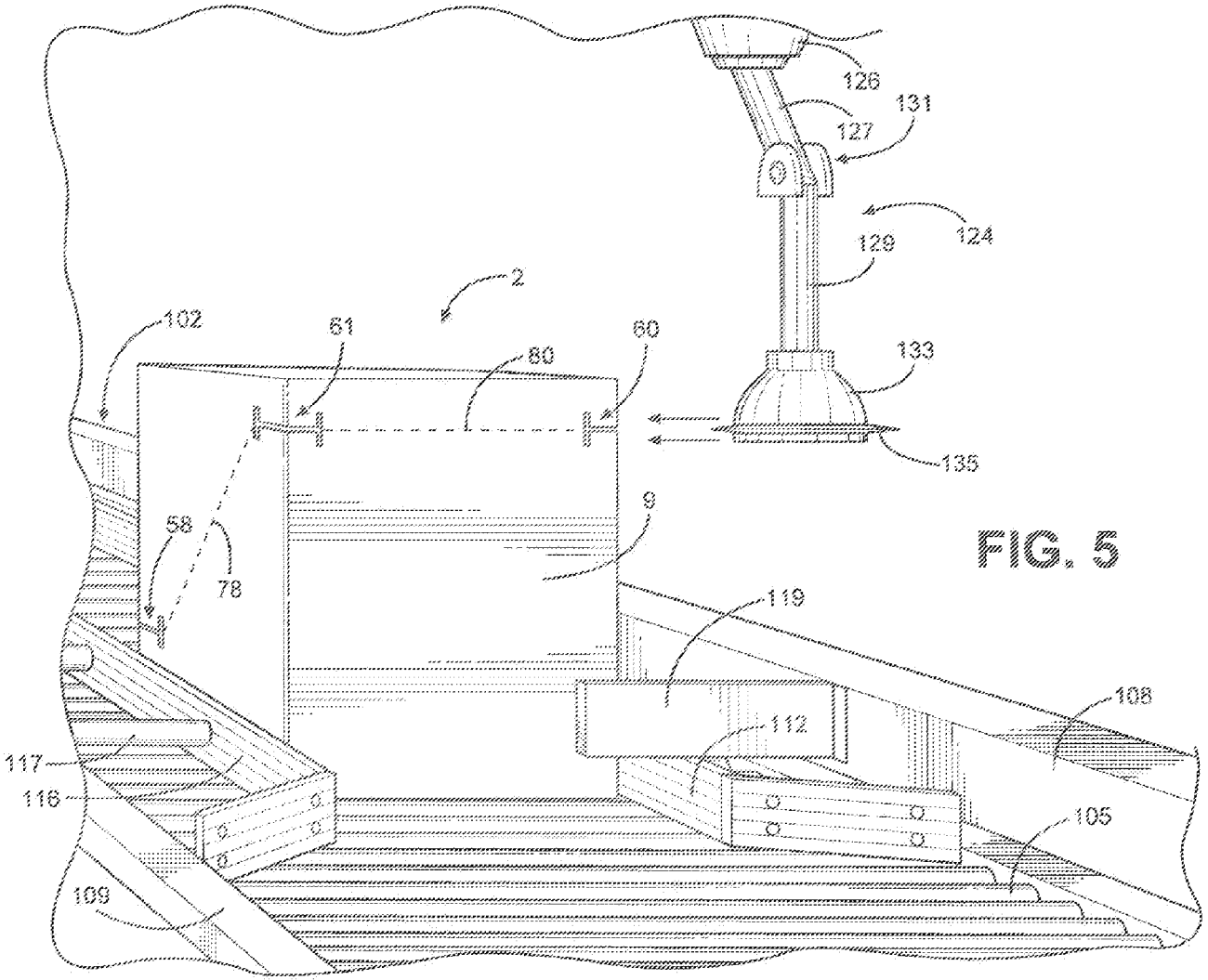
FIG. 5 is a partial view of an automated apparatus employed in cutting the container of FIG. 1.

In accordance with the invention, the various cuts to be made can be done manually or through an automated arrangement. FIG. 5 illustrates an exemplary automated system wherein a conveyor 102 is provided with a plurality of base rollers 105 upon which container 2 can be directed and held in the desired position during a cutting operation. As illustrated, conveyor 102 also includes side supports 108 and 109 between which the base rollers 105 extend. Also provided is a lateral guide rail 112 provided at a position spaced from side support 108, as well as a positioning arm assembly 116 adjacent side support 109. In the embodiment shown, positioning arm assembly 116 is shiftable relative to side supports 108 and 109 in order to accommodate containers of varying widths. For this purpose, positioning arm assembly 116 is also provided with one or more actuators 117 which can be shifted, such as linearly, to vary a distance between positioning arm assembly 116 and lateral guide rail 112. When container 2 is appropriately arranged between lateral guide rail 112 and positioning arm assembly 116, a container engaging member 119 further aids to retain container 2 in a desired cutting position. Thereafter, a robotic cutter arm assembly 124 is used to make the desired cuts in container 2. As shown, cutter arm assembly 124 is provided with a movable support block 126 from which extends a first support arm 127. Cutter arm assembly 124 also includes a second arm 129 which is pivotally interconnected to first arm 127 through a mechanical joint 131. Second arm 127 supports a cutter head 133 provided with a blade 135.

At this point, it should be recognized that cutter arm assembly 124 is not considered part of the present invention and is merely provided for the sake of completeness. Therefore, the particular construction and operation of cutter arm assembly 124 can greatly vary. In any case, with this arrangement, cutter arm assembly 124 can be maneuvered to cut between corner slits 58-61 and along cut lines 77-80, while not having to cut through fold lines 21-24 in order to transform container 2 from the condition shown in FIG. 1 to the display case/container arrangement shown in FIG. 4. That is, cutting head 133 can be angled and manipulated through arms 127 and 129 to perform the various cuts. Slight variations in the dimensions in container 2 will not keep cutter arm assembly 124 from making a nice clean cut given the specific inclusions of secondary slit portions 69 and 70 for each corner slit 58-61.

Figure 6:
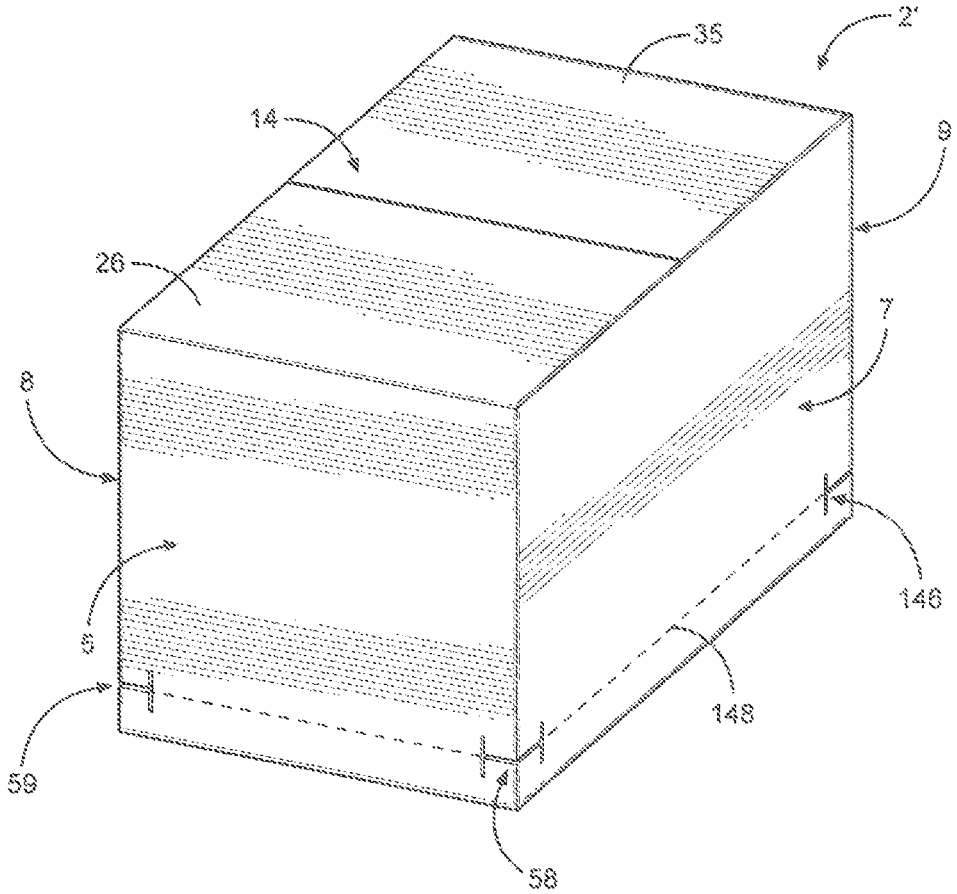
FIG. 6 is a perspective view, similar to that of FIG. 1, but showing the container constructed in accordance with a second embodiment of the invention.

As indicated above, the particular location of corner slits 58-61 can vary in accordance with the invention. For instance, FIGS. 3 and 6 illustrate alternative configurations wherein corner slits 58 and 59 remain at the same location but the container 2 is shown to include corner slits 145 and 146 which are generally located at the same level as corner slits 58 and 59. In a manner directly analogous to cut lines 78 and 79, corner slits 145 and 146 can be connected to adjacent slits with various indicator or cut lines, such as that indicated in FIG. 6 at 148 between corner slit 58 and corner slit 146, to establish a guide for the cutting operation.

Based on the above, it should be readily apparent that the construction of the container in accordance with the invention enables the container to be readily cut, whether manually or through an automated cutting apparatus, without the need to cut through corner portions or follow precise cutting lines. In accordance with one aspect of the invention, a packaging container can be readily converted to a display container. However, the invention can also be employed in connection with just exposing products packaged in a container. Although described with reference to certain embodiments of the invention, it should be readily understood that various changes and/or modifications can be made to the invention without departing from the spirit thereof. For instance, as referenced above, the location of the corner slits could be readily varied to establish a wide range of display container configurations. In addition, as indicated above, the secondary slits need not be perpendicular to the primary slits but could be angled in other fashions. In fact, it should be recognized that the various secondary slit portions associated with the corner slits can intersect the primary slit portions at a wide range of acute or obtuse angles so long as the secondary slit portions are spaced from the corners and not aligned with the primary slit portions. Also, the extent of the second slit portions can greatly vary in accordance with the invention and, in fact, need not extend both above and below the primary slit portions. The slits or cuts can actually be established by die cuts wherein a portion of material is removed at the ends of the primary slits, with the removed material establishing a void in a geometric shape, such as a circle, square, triangle or the like. Furthermore, it should again be noted that the inclusion of cut lines is optional. In accordance with the illustrated embodiments, the cut lines are just markings, although perforations or the like could be employed if structural integrity of the container was not an issue. Also, the corrugations of the container can be vertical or horizontal depending upon the need for more top-to-bottom or side-by-side strength respectively. Although cartons of cereal are packaged in the embodiment disclosed, the invention can be used with a wide range of shipped articles, including all sorts of food and non-food products. Certainly, it should be recognized that the number of sides of the container incorporating the invention can greatly vary and any reference to front, back, side or the like in referring to the panels is merely for reference purposes such that these terms equally just refer to side panels of the container in connection with the description and claims. Finally, the invention has been described in connection with cutting the container into upper and lower container sections, while it should be understood that further cuts could also be made, such as cutting a container to establish a top section or cap, a middle body tube section, and a bottom section or cap. Whether cut into two or more sections, the top and bottom sections could be similarly configured, which actually results in connection with the embodiments discussed in detail above, so that each container can be cut to result in multiple display containers for storing products. In connection with making the cuts, the containers could be printed with product information which is strategically placed relative to the cut lines such that display or other information is not removed and discarded upon creating the display containers. If the cuts are made to established multiple display containers from a single container, duplicate information can be provided in different locations, even upside down in predetermined spots, to assure legibility when the resulting display containers are utilized. In general, the invention is only intended to be limited by the scope of the following claims.

The invention claimed is:

1. A container for containing various articles comprising: a plurality of panels interconnected through corner portions each of which is provided with a corner slit, each of said corner slits including a primary slit portion extending from one of the plurality of panels, through a respective said corner portion and into another one of the plurality of panels, each of said corner slits also including secondary slit portions extending through the one and the another of the plurality of panels, respectively, at positions spaced from the corner portion and intersecting the primary slit portion at non-linear angles, wherein the container is pre-cut at the corner portions by the corner slits and can be cut into upper and lower container portions solely by cutting the plurality of panels between adjacent ones of the secondary slit portions.

2. The container according to claim 1, wherein each of the secondary slit portions extends substantially perpendicular to the primary slit portion.

3. The container according to claim 1, wherein each of the secondary slit portions extends both above and below the primary slit portion.

4. The container according to claim 1, wherein the corner slits are provided at both upper and lower regions of the container such that, upon cutting the plurality of panels between adjacent ones of the secondary slit portions, at least two of the plurality of panels include sloping upper edges.

5. The container according to claim 4 wherein, upon cutting the plurality of panels between adjacent ones of the secondary slit portions, at least two of the plurality of panels include the sloping upper edges and at least two additional ones of the plurality of panels include generally horizontally extending upper edges.

6. The container according to claim 1, wherein the corner slits are provide at lower regions of the container such that, upon cutting the plurality of panels between adjacent ones of the secondary slit portions, each of the plurality of panels includes a generally horizontally extending upper edge.

7. The container according to claim 1, wherein the container is formed of corrugated paperboard and the corner portions are defined by fold lines.

8. The container according to claim 1, further comprising cut lines, just in the form of markings, extending between adjacent ones of the secondary slit portions on each of the plurality of panels.

9. The container according to claim 1, further comprising product boxes contained in the container.

10. The container according to claim 9, wherein the product boxes are cartons of cereal.

11. A container for containing various articles comprising: front, back, side, bottom and top panels formed by folding a paperboard blank along fold lines defining corner portions between at least the front, back and side panels, each of the front, back and side panels being pre-formed with corner slits including a primary slit portion extending entirely from and through one of the front, back and side panels and an adjacent one of the front, back and side panels, as well as secondary slit portions extending through the one and the adjacent one of the front, back and side panels at positions spaced from a respective said corner portion and intersecting the primary slit portion at non-linear angles, wherein the container is pre-cut at the corner portions by the corner slits and can be cut to establish a display container solely by cutting between adjacent ones of the secondary slit portions on each of the front, back and side panels.

12. The container according to claim 11, wherein each of the secondary slit portions extends substantially perpendicular to the primary slit portion.

13. The container according to claim 11, wherein each of the secondary slit portions extends both above and below the primary slit portion.

14. The container according to claim 11, wherein the corner slits are provided at both upper and lower regions of the container such that, upon cutting the plurality of panels between adjacent ones of the secondary slit portions, at least two of the front, back and side panels include sloping upper edges.

15. The container according to claim 14 wherein, upon cutting the plurality of panels between adjacent ones of the secondary slit portions, the side panels include the sloping upper edges and the front and back panels include generally horizontally extending upper edges.

16. The container according to claim 11, wherein the corner slits are provide at lower regions of the container such that, upon cutting the plurality of panels between adjacent ones of the secondary slit portions, each of the front, back and side panels includes a generally horizontally extending upper edge.

17. The container according to claim 11, wherein the container is formed of corrugated paperboard and the corner portions are defined by fold lines.

18. The container according to claim 11, further comprising cut lines, just in the form of markings, extending between adjacent ones of the secondary slit portions on each of the front, back and side panels.

19. The container according to claim 11, further comprising product boxes contained in the container.

20. The container according to claim 19, wherein the product boxes are cartons of cereal.

21. A method forming a display container from a container having a plurality of panels interconnected through corner portions comprising:

pre-slitting each corner portion of the container with a primary slit portion extending entirely through the corner portion into adjacent ones of the plurality of panels, along with secondary slit portions intersecting the each primary slit portion at a non-linear angle in each of the adjacent ones of the plurality of panels, respectively;

loading the container with products after the corners portions are pre-slit; and separating an upper portion of the container from a lower portion by just cutting the plurality of panels between the secondary slit portions on each panel.

22. The method of claim 21, wherein the container is loaded with cartons of cereal.

23. The method of claim 21, wherein cutting the plurality of panels constitutes cutting corrugated paperboard.

24. The method of claim 23, further comprising: forming the corner portions of the corrugated paperboard by folding the plurality of panels along fold lines.

25. The method of claim 21, wherein cutting the plurality of panels includes following cut lines, just in the form of markings, extending between adjacent ones of the secondary slit portions on each of the plurality of panels.

26. The method of claim 21, wherein pre-slitting each corner portion includes forming the secondary slit portions substantially perpendicular to the primary slit portion.

27. The method of claim 21, wherein pre-slitting each corner portion includes extending the secondary slit portions both above and below the primary slit portion.

28. The method of claim 21, wherein the corner slits are provided at both upper and lower regions of the container such that, upon cutting the plurality of panels between adjacent ones of the secondary slit portions, at least two of the panels include sloping upper edges.

29. The method of claim 28 wherein, upon cutting the plurality of panels between adjacent ones of the secondary slit portions, some of the plurality of panels include the sloping upper edges and others of the plurality of panels include generally horizontally extending upper edges.

30. The method of claim 21, wherein the corner slits are provide at lower regions of the container such that, upon cutting the plurality of panels between adjacent ones of the secondary slit portions, each of the plurality of panels includes a generally horizontally extending upper edge.

* * * * *